US005201437A

United States Patent [19]

Burgdorf

[11] Patent Number: 5,201,437

[45] Date of Patent: Apr. 13, 1993

[54] WIDEMOUTH STEEL DRUM OF CONICAL SHAPE

[75] Inventor: Märten Burgdorf, Heimerzheim, Fed. Rep. of Germany

[73] Assignee: Mauser-Werke GmbH, Bruhl, Fed. Rep. of Germany

[21] Appl. No.: 939,385

[22] Filed: Aug. 31, 1992

Related U.S. Application Data

[63] Continuation of Ser. No. 698,511, May 10, 1991, abandoned.

[30] Foreign Application Priority Data

Aug. 9, 1990 [DE] Fed. Rep. of Germany ... 9011586[U]

[51] Int. Cl.[5] ..... B65D 41/00

[52] U.S. Cl. ..... 220/601; 220/320; 206/515

[58] Field of Search ..... 220/601, 320; 206/515, 206/518

[56] References Cited

U.S. PATENT DOCUMENTS

| | | | |
|---|---|---|---|
| 2,354,425 | 7/1944 | Kuhn | 220/601 |
| 2,915,330 | 12/1959 | Verbiar | 220/320 |
| 3,561,637 | 2/1971 | McConnell | 220/320 |

FOREIGN PATENT DOCUMENTS

| | | | |
|---|---|---|---|
| 236860 | 12/1962 | Austria | 220/601 |
| 7812594 | 12/1978 | Netherlands | 220/601 |
| 636448 | 4/1950 | United Kingdom | 220/601 |

*Primary Examiner*—Joseph Man-Fu Moy
*Attorney, Agent, or Firm*—Pennie & Edmonds

[57] ABSTRACT

A widemouthed, open topped steel drum of conical shape, having a large filling and emptying opening capable of being closed, in liquid-tight condition, by means of a lid and a tension ring. The sidewall of the drum has an encircling bead which, upon nesting of two empty drums, rests on the top edge of the drum beneath. The bottom of the drum has at least one closeable bunghole through which the upper drum can be engaged to remove it from the lower drum of a stacked pair.

10 Claims, 4 Drawing Sheets

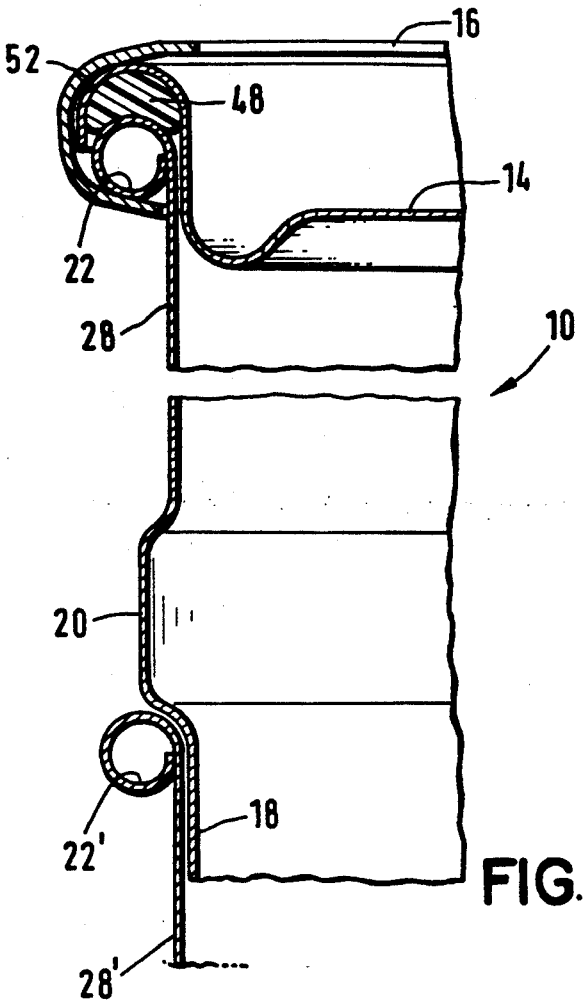
FIG.2
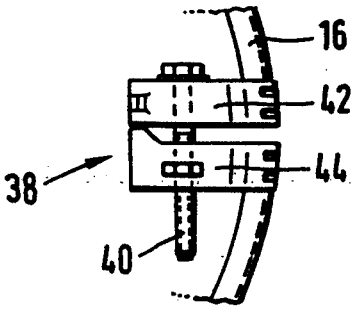
FIG. 5
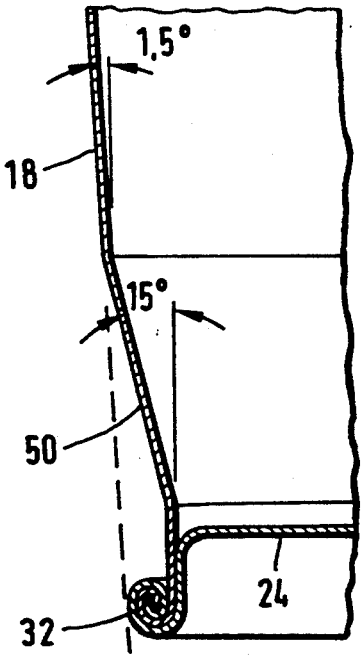
FIG. 3
FIG. 4
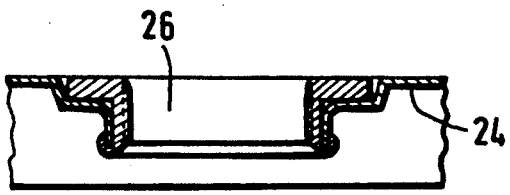

WIDEMOUTH STEEL DRUM OF CONICAL SHAPE

This is a continuation of application Ser. No. 698,511, filed May 10, 1991, now abandoned.

BACKGROUND OF THE INVENTION

The invention relates to a widemouth open topped steel drum of conical shape, having a large filling and emptying opening defined by a rolled rim formed at the upper end of the sidewall of the drum. The drum is capable of being closed, in liquid-tight condition, by means of a lid and a tension ring. The sidewall of the drum, in the zone near the open top, has an encircling outwardly directed stacking bead which, upon nesting of two or more empty steel drums, serves as an outer ledge for the upper nested drum for seating on the top rim of the drum beneath.

Such drums or similar vessels of large volume are generally known. Widemouthed drums of conical shape have the advantage that they can be nested empty, and thus stored and transported in large quantities at low cost.

In the transport of stacked drums, they may sometimes be shaken down one into another so hard that subsequent unstacking or separation of the several drums presents great problems and requires the exertions of at least two people. Often, for example, the rolled-out flange or lid rim of the stacked drum have to be hit with a hammer in order to separate two drums wedged together. In the course of such time-consuming and personnel-intensive efforts, the body of the vessel or the rim of the filling opening may easily be damaged, with subsequent leakage as the result.

SUMMARY OF THE INVENTION

Against this background, the object of the present invention is to provide a conformation for widemouthed steel drums of conical shape, in particular steel drums of large capacity and consequently heavy weight, permitting such steel drums to be easily unstacked without damage and by one individual, unaided. This object is accomplished, according to the invention, in that the drum has at least one bunghole in the bottom of the drum. The bunghole is closable in a liquid-tight manner by means of a cap. With this construction, it is possible to introduce a tool such as, for example, a puller or spindle through the bottom bunghole of the lower drum of a pair of jammed drums and force out the upper drum without damage and by one individual with only a minor application of force.

Expediently, the closable bunghole may be arranged centrally in the bottom. This ensures that the drums can be unnested without canting. However, two diametrically opposed or a plurality of symmetrically arranged closable bungholes can be provided in the bottom of the drum so that a uniform, symmetrical application of force can be made through them by means of a suitable tool.

The additional bunghole centrally arranged in the bottom of the drum further affords the great advantage that in reconditioning the drums, which are intended and especially suitable for multiple use, the cleaning operation is greatly facilitated. The bottom of the drum is bulged slightly outwardly to ensure that no liquid wash will remain in the drum, all of it being completely drained through the hole in the bottom. The large top filling opening ensures ready accessibility for cleaning implements such as rotary brushes or steam jets, and the liquid wash can drain out completely without need for inverting the drum or for special handling.

For the steel drums according to the invention, the drum wall between the stacking bead and the rolled rim of the top filling opening at the top of the drum is cylindrical. Below the stacking bead, the drum wall is slightly tapered to or nearly to the bottom of the vessel. The taper of the vessel wall is between 5.5% and 11%, preferably about 7%. This provides better stability and compactness of lidded drums when full and closed.

The tapered steel drums according to the invention, in particular those having a capacity of 200 liters, are intended for use with foodstuffs, for example, honey, tomato extract, oils, fats or fruit concentrate. In the chemical industry, where the drum is used for the transport of chemical products, the drum of the present construction is especially suitable for solid and liquid hazardous materials.

A very special application for the steel drum according to the invention is its use as a so-called "honeytainer" for transporting honey between distant points. As a result of convenient nestability, there is firstly an enormous saving of space in the transport and warehousing of empty lidded drums at comparatively much lower cost. This factor renders the distant overseas transport of such steel drums of conical shape economically feasible. Given a container or truck of 100 $m^3$ transport capacity, for example, only 292 conventional (unnested) lidded drums can be carried, as opposed to 938 nested lidded drums of conical shape. This results in a saving of approximately 70% in transport costs.

In the transport of honey in large capacity drums the honey is generally present in a solid block and is normally very difficult to remove from the drums. The use of the lidded drums according to the invention provides an alternative emptying procedure. The tapered steel drum is briefly heated from the outside, for example by contact with steam or hot water, so that the honey at the inner wall will melt to a thin film and become fluid. In addition, a gas pressure hose may be connected to the bunghole in the bottom of the drum and the solid block of honey can be forced out of the inverted drum by gas pressure.

The use of gas or fluid pressure, (e.g., water or compressed air) applied to the bunghole in the bottom of the drum, may similarly be employed for example for unstacking nested drums, or freeing jammed drums from each other.

BRIEF DESCRIPTION OF THE DRAWINGS

FIG. 2 is a partial longitudinal section of the upper wall with lid and tension ring;

FIG. 3 is a partial longitudinal section of the lower wall and bottom of the drum;

FIG. 4 is a partial section of the bottom of the drum showing a bunghole centrally arranged in the bottom;

FIG. 5 is a partial view of a tension ring with an internal closure mechanism;

FIG. 1 shows a tapered 200 liter widemouthed open topped steel drum 10 according to the invention in the form of what is known as a "honeytainer." The steel drum 10 has a large top filling and emptying opening 12 defined by the rolled rim 22. The opening is closed in a liquid-tight manner with a lid 14 and tension ring 16. In the vicinity of the open top of the drum, the sidewall of the drum has an encircling radially outwardly extending stacking bead 20. This bead divides the sidewall into an upper wall section which is cylindrical up to the rolled rim 22 of the top opening 12, and a lower wall section 18 below the bead 20 which is slightly tapered almost down to the bottom 24 of the drum. The taper of the wall 18 is between 5.5% and 11%, preferably about 7%. The rolled rim 22 at the top opening 12 of the drum 10 serves as a seat for the edge of the lid 14 and as a purchase surface for the tension ring 16.

Figure 1:
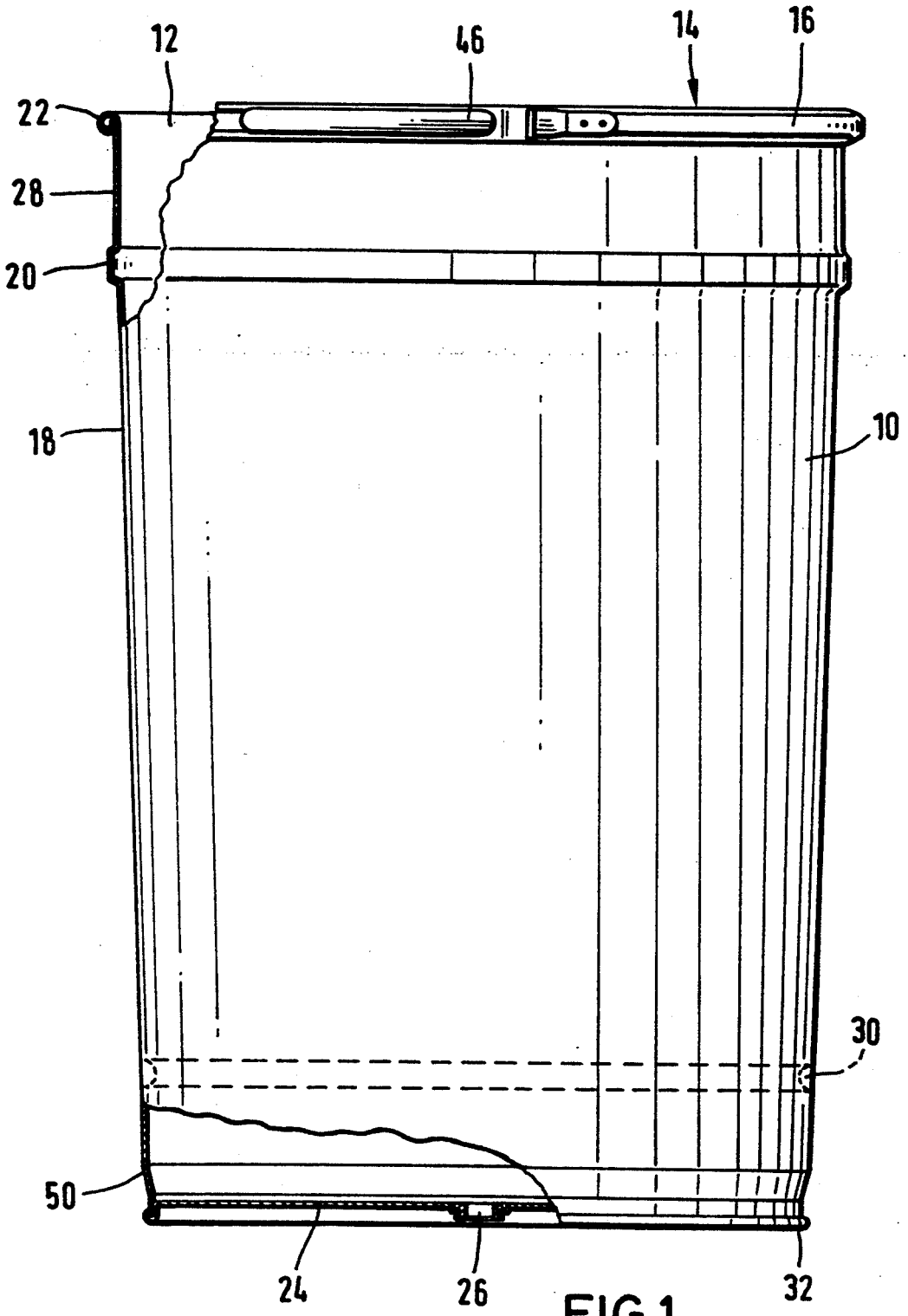
FIG. 1 is a side view of a tapered widemouthed steel drum, with lid and tension ring, of the present invention, partially in cross-section.

In the bottom 24 of the drum a bunghole 26 is provided. This bunghole is closable in a liquid-tight manner by means of a bung, such as a screw cap. The bunghole 26 is fitted, depending on the size of the drum, with a ¾" or 2" internally threaded sleeve 26' to accept a threaded bung.

The provision of the bunghole in the bottom of the drum permits the use of a suitable unstacking tool. The bottom bunghole also facilitates the cleaning operation in reconditioning.

For a 200 liter widemouthed steel drum, the inside of the drum is either an unfinished surface or baked enamel (a finish resistant to caustic materials). The outside of the drum is coated, if desired with polyethylene "inliner PE", for example 0.3 mm in thickness.

The top outside diameter, measured across the tension ring, is 610 mm; the bottom outside diameter is 516 mm; the top inside diameter is 571.5 mm; while the inside height is 870 mm and the outside height is 880 mm. The diameter measured across the stacking bead is 582 mm. The bead itself is a flat bead having a width of 44 mm. The stacking bead however, may alternatively be narrower, e.g., only about 25 mm in width, or made in the form of a standard round bead. The unit weight of the drum, depending on a sheet thickness of between 1.5 to 0.7 mm, is approximately 21.2 kg to 13 kg. The lid weight is approximately 3.7 kg and the ring weight is approximately 1.0 kg.

The sidewall 18,28 of the drum 10 is preferably made out of a cylindrical blank widened to its conically tapered shape of larger diameter (up to 572 mm max.) by expanding from a smaller diameter (e.g., about 514 mm).

In the lower portion of the tapered wall 18, a second bead 30 is provided. This bead is directed inwardly. By virtue of this second, inwardly directed bead, shown in dotted line in FIG. 1, the upper drum of each stacked pair will not be suspended only at the upper stacking bead 20, but will also rest on the lower bead 30.

In FIGS. 2–4, the several features of the steel drum 10 are represented in partial view on a larger scale.

In FIG. 2, the rim 52 of the lid 14 of the drum is shown as fitted with packing 48 to seal the drum 10 and the lid 14 upon tightening of the tension ring 16 into place. This produces a gas and liquid-tight seal against the rolled bead 22 of the top opening 12.

In the case of a 200 liter drum, the bottom edge of the flat stacking bead 20 is about 130 mm distant from the rolled bead 22. When two drums are nested, the upper one projects from the lower one by that amount. The top edge of the rolled rim 22' of the bottom drum 10' will then rest against the bottom edge of the stacking bead 20 of the upper drum 10.

FIG. 3 shows an outwardly directed seam 32 connecting the bottom 24 of the drum with a lower wall section 50 of the wall 18. The wall section 50 is additionally tapered or reduced in diameter so that the crimp 32 lies within an imaginary prolongation of the tapered wall 18. The inclination of the tapered wall 18 to the longitudinal centerline of the drum is about 1.5°, and the inclination of the short bottom wall section 50 above the bottom seal 32 and relative to the longitudinal centerline of the drum is about 15°.

The bottom 24 of the drum is recessed a distance from the bottom edge of the seam 32. This recess provides a space so that when the bung is screwed into the central bottom bunghole 26, especially if the bottom is slightly convex in shape, no pressure will be exerted on the bung by the support floor on which the drum is placed.

The bunghole 26 shown in FIG. 4 and the matching bung are preferably provided with a temperature-resistant S-seal. Since the steel drums are intended for multiple use or repeated use (e.g., 5 to 10 times) and may be cleaned with steam jet devices, temperatures up to 200° C. may easily occur.

FIG. 5 shows a portion of a tension ring 16 with an internal closure mechanism 38. The internal closure mechanism 38, which is intended to permit the drums to be rolled freely, consists of a screw 40 acting between two clisp 42, 44. Alternatively, however, as in the case of external tension rings, the closure mechanism can take the form of a conventional toggle closure.

Figure 6:
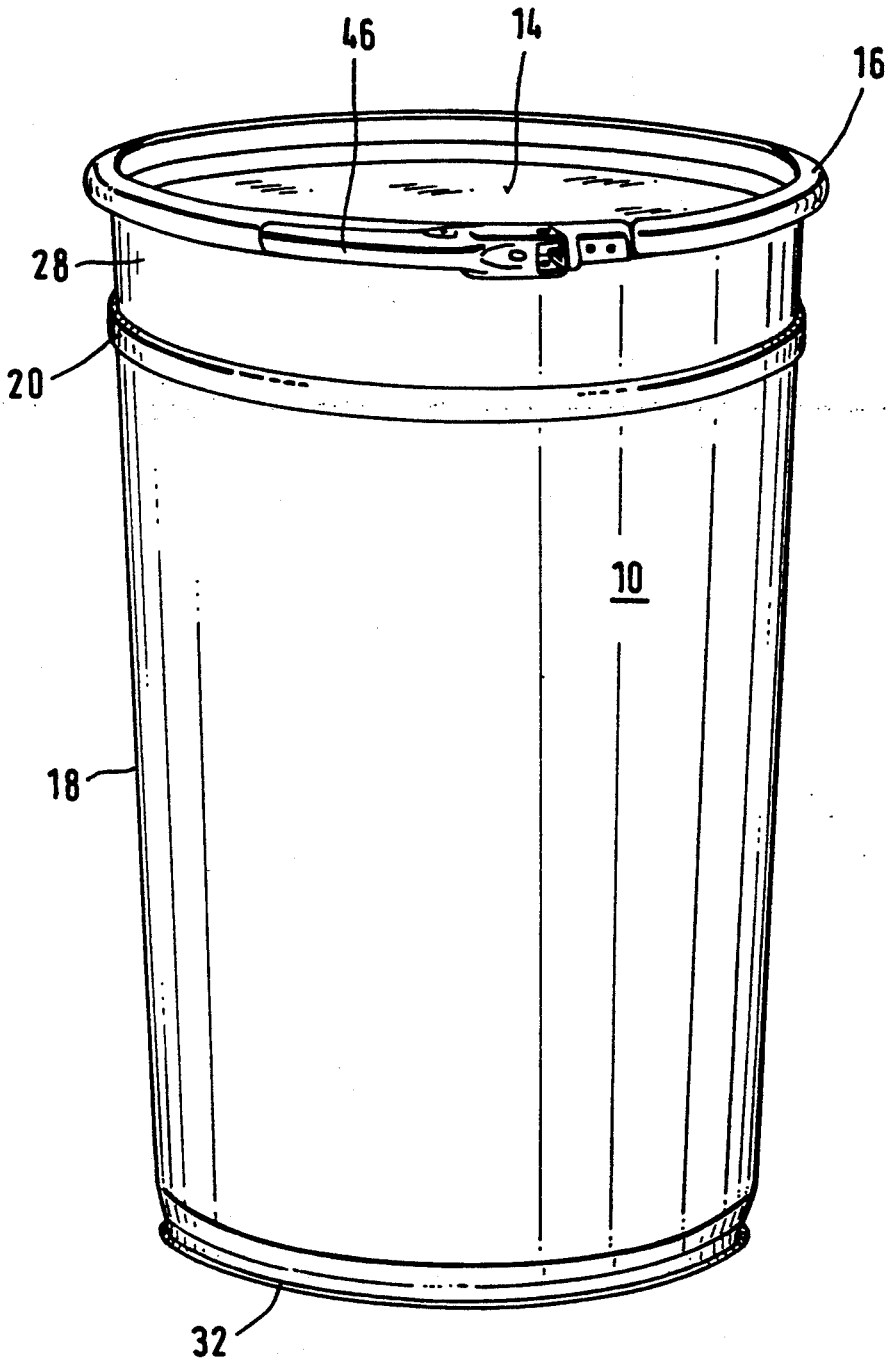
FIG. 6 is a perspective view of a tapered lidded drum with lid and tension ring in place.

FIG. 6 shows a perspective view of a closed 200 liter drum 10 with lid 14 and tension ring 16 having an external toggle closure 46. The stacking bead 20 between the upper cylindrical wall 28 and lower tapered wall 18 here takes the form of a narrow flat bead.

Figure 7:
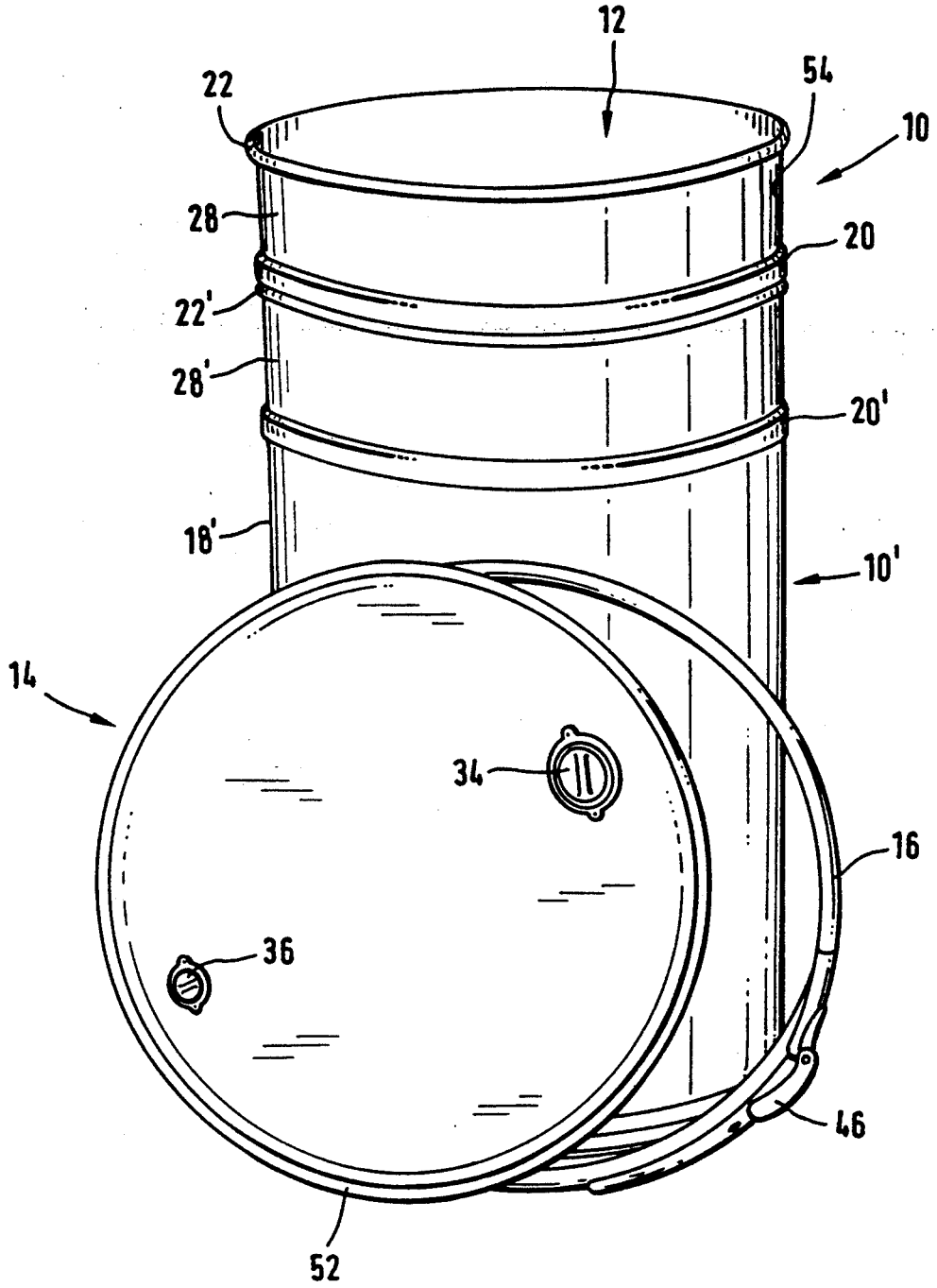
FIG. 7 is a perspective view of two nested steel drums with a lid and tension ring placed in front of them.

In the perspective view of FIG. 7, two drums 10, 10' are nested. The drums 10, 10' are here provided with a conventional round bead 20, 20' for stacking.

In the top drum 10, a thin-walled inliner 54, e.g. of polyethylene has been inserted, to facilitate and accelerate reconditioning of the drums for certain highly adhesive contents.

The corresponding tension ring 16 is provided with overlapping ends and powerful toggle closure 46, avoiding leakage of the drums even when dropped from a greater height.

In a preferred embodiment, the lid is provided with at least one closable bunghole for sampling the contents of the drum. In the case shown in FIG. 7, two opposed bungholes and bungs of different sizes are provided in the lid. One bung is a large 2" bung 34 and the other is a smaller 2/4" bung 36. When the lid is provided with only one central bung, it is preferably a large 2" bung.

From the above description, the advantageous configuration and economy of the widemouthed steel drum according to the invention, will be apparent. With the central bung in the bottom there is the resulting possibility of using a suitable device for simple separation or unstacking of such tapered drums stacked one inside another. Also, the tapered construction provides for economical transport and protection against damages during transportation.

I claim:

1. In a widemouthed open topped steel drum of conical shape having a large top filling and emptying opening defined by rolled rim (22) at the upper end of the sidewall of the drum, the drum being closable in a liquid-tight manner by means of a lid and tension ring, and having a sidewall near the top opening with an encircling stacking bead directed radially outwardly and which, upon nesting of at least two such empty steel drums, provides an outer ledge on the upper stacked drum for resting on the rim (22) of the top opening of the second drum, stacked beneath to define a closed space between the stacked drums beneath the rim (22) of the top opening of said second drum, the improvement characterized in that the steel drum (10) has at least one bunghole (26) in the bottom wall (24) of the drum, closable in a liquid-tight manner by means of a bung cover, said bunghole (26) communicating with said closed space to connect said space to atmosphere through the upper stacked drum and to permit insertion of a tool through the upper stacked drum and said bunghole (26) to assist in pulling the upper stacked drum from said second drum.

2. Steel drum according to claim 1, characterized in that at least one closable bunghole (26) is arranged centrally in the bottom.

3. Steel drum according to claims 1 or 2, characterized in that the sidewall of the drum includes a cylindrical sidewall section (28) between the stacking bead (20) and the rolled rim (22) of the top opening (12) and a sidewall section (18) below the stacking bead (20) which is slightly conical in shape, almost down to the bottom (24) of the drum.

4. Steel drum according to claim 3, characterized in that the conicity of the sidewall section (18) is between 5.5% and 11%, preferably about 7%.

5. Steel drum according to claims 1 or 2 characterized in that the bottom (24) conformation is slightly convex outward.

6. Steel drum according to claim 3, characterized in that the sidewall sections (18, 28) of the drum (10) are constructed of a cylindrical blank enlarged by a stretching or expanding operation from a smaller diameter to the conically tapered shape of the drum.

7. Steel drum according to claim 3 characterized in that a second bead (30) is provided in the lower sidewall section (18) of the drum, said second bead extending radially inwardly and spaced from the stacking bead (20) by a distance equal to the distance between the stacking bead (20) and a bottom-most peripheral portion (32) of the drum.

8. Steel drum according to claim 7, characterized in that the bottom-most peripheral portion (32) of the drum is defined by a connecting seam (32) connecting a sidewall section (50) disposed radially outwardly of the peripheral portion to the bottom (24) of the drum and further characterized in that the sidewall section (50) immediately above the seam (32) is additionally tapered beyond the taper of the sidewall section (18) so that the connecting seam (32) between bottom (24) and sidewall (50) lies within an imaginary prolongation of the tapered sidewall section (18).

9. Steel drum according to claim 8, characterized in that the lid (14) of the drum has at least one closable bunghole (34, 36) therein.

10. Steel drum according to claim 8, characterized in that the tension ring (16) has a closure mechanism (38) arranged on the surface of the lid (14) radially inwardly of the rim of the drum.

* * * * *